US006116135A

United States Patent [19]

Wagner

[11] Patent Number: 6,116,135

[45] Date of Patent: Sep. 12, 2000

[54] UNITARY RESILIENT COVER FOR ROTARY ANVIL

[76] Inventor: Kenneth Wagner, Wagner Industries, 2 Starter Dr., Frackville, Pa. 17931

[21] Appl. No.: 09/404,735

[22] Filed: Sep. 24, 1999

Related U.S. Application Data

[63] Continuation of application No. 09/013,104, Jan. 26, 1998.

[51] Int. Cl.[7] ..... B26D 7/20

[52] U.S. Cl. ..... 83/698.42; 83/659

[58] Field of Search ..... 83/698.42, 659

[56] References Cited

U.S. PATENT DOCUMENTS

| | | | |
|---|---|---|---|
| 3,274,873 | 9/1966 | Sauer | 83/659 X |
| 3,282,142 | 11/1966 | Suaer | 83/659 |
| 3,522,754 | 8/1970 | Sauer | 83/659 |
| 3,522,762 | 8/1970 | Sauer | 83/659 X |
| 3,577,822 | 5/1971 | Sauer et al. | 83/659 |
| 3,739,675 | 6/1973 | Duckett et al. | 83/659 |
| 3,885,486 | 5/1975 | Kirkpatrick | 83/659 |
| 4,075,918 | 2/1978 | Sauer | 83/659 |
| 4,791,846 | 12/1988 | Kirkpatrick | 83/659 |
| 4,848,204 | 7/1989 | O'Connor | 83/659 |
| 4,982,639 | 1/1991 | Kirkpatrick | 83/659 |

*Primary Examiner*—M. Rachuba
*Assistant Examiner*—Charles Goodman
*Attorney, Agent, or Firm*—A. R. Eglington

[57] ABSTRACT

There is provided a resilient cover for a die-cutting rotary anvil comprising a flexible elastomeric member of one integral piece, having its longitudinal ends provided with at least one complemental set of transversely aligned and interlocking means, whereby the single cover piece may be flexed markedly, and conjoined at its longitudinal ends to form a sleeve-like cover for the anvil and remain functional in a stable and durable manner. The cover further includes one or more anchoring annular rails, located longitudinally along the inner surface of the cover.

10 Claims, 2 Drawing Sheets

UNITARY RESILIENT COVER FOR ROTARY ANVIL

CROSS REFERENCE TO OTHER APPLICATIONS

This is a continuation in part of my copending, examinable patent application filed Jan. 26, 1998, under Ser. No. 09/013,104.

FIELD OF THE INVENTION

The present invention relates generally to the rotary die cutting art, and more particularly, to an improved, single piece, rotary anvil cover used in the cutting of corrugated boxes from box board-type paper, and the like.

BACKGROUND OF THE INVENTION

In the field of rotary die cutting, corrugated board, or like material to be cut, is fed into the nip of a pair of rotating rollers, wherein one roller is equipped with radially extending cutting edges, and the other roller (the "anvil") is equipped with a surface upon which the cutting edges of the die may bear during the cutting operation. The outer surface of the anvil preferably is a replaceable cover of thermosetting but resilient material such as polyurethane plastic, and the like. Resilient anvil covers may be made in a continuous circle (tube-like), with the cover being pushed longitudinally upon the anvil base (as a ring is placed on a finger). However, it has been found desirable from the standpoint of mounting an anvil cover on a base anvil member, to employ a unitary cover which may be wrapped around the base member and locked in place. This permits the said cover to include and employ circumferential disposed integral ribs, extending radially inwardly from the cover inner surface so to engage appropriately positioned circumferential grooves (slots) in the outer arcuate surfaces of the support member.

Anvil covers of this type may be provided in two or more pieces, the ends of which may similarly interlock or, as a single length, the two ends thereof also being adapted to interlock when the cover is mounted on the base anvil member. A successful interlocking system is shown in U.S. Pat. No. 3,522,754 (1970), wherein mating ends of the anvil cover are provided with alternating lugs and recesses of the depicted form. In mounting an anvil cover of this type upon a support, the cover is wrapped upon the support and the interlocking ends are merely pressed together to provide a strong seam. U.S. Pat. No. 3,577,822 (1971) described a two element resilient cover.

It is desired that an anvil cover be capable of withstanding many thousands of cutting operations before the eventual replacement thereof is necessary. Further, it is desired that the entire surface of the anvil cover be available for use, including the area wherein the seams between connecting (interlocked) cover ends are located. The dual seams of two element covers complicate this functional objective. The present configuration obviates the largely cut out midline that becomes the fatigue line of the prior art covers.

ADVANTAGES OF THIS INVENTION

It is, therefore, a principal object of this invention to provide a self-lockable, single piece, anvil cover that eliminates one of the weak end unions necessarily occurring with prior art two element, anvil covers.

Another object of the invention is to provide for dovetailed interlocking means to ensure that the anvil cover, upon mounting, will not be stretched to unusable lengths, such stretching normally being induced by the cutting blade often penetrating the box board stock into the cover surface.

A still further object of this invention is to provide a one-piece anvil cover having a manual, easy-on, locking configuration when being newly installed; and, as well, to provide an easy off feature, whereby operational deterioration of the cover is prevented, thus permitting the reinstallation of a used anvil cover for later runs of the same cutting pattern.

It is a still further object of the invention to provide a cover interlocking means for the full band width of the cover surface, including any underlying rails, so as to obtain solid cover contact with the rotary anvil, and serving to counteract the normal cutting forces imposed.

Yet another object of the invention is to provide for angled interlocking edges for the tongues and grooves, whereby such interlocked elements being located across the cover seam, are such as to preclude the cutting means from cutting through the anvil cover unduly.

SUMMARY OF THE INVENTION

Accordingly there is provided a resilient cover for a die-cutting rotary anvil comprising a flexible member of one integral piece, having its longitudinal ends provided with at least one complemental set of transversely-aligned and interlocking means, whereby the single cover piece may be flexed markedly, and conjoined at its longitudinal ends to form a sleeve-like cover for the anvil and remain functional in a stable and durable manner. The cover further includes one or more annular rails, located longitudinally along the inner surface of the cover. They are positioned for deposition in complemental annular slots permanently machined into the outer surfaces of the cylindrical cover-supporting component of the rotary anvil.

Each cover interlocking surfaces has at least one forked tongue configuration disposed intermediate the lateral edges at one longitudinal end of the cover piece, and at least one complemental V-shaped groove disposed at the other longitudinal end of the same stock piece, with each finite length being sufficiently adapted to flex into a collar-like cover member. One object of the present invention include a unitary flexible cover for a rotary anvil head, as described, which is an acceptable commercial solution to the present binding and tearing loose problem now seen in free wheeling, flexible anvil covers of this type. The present cover is of a sturdy and long wearing construction, adapted to further increase the working life of a free wheeling, anvil cover. It can be readily applied to, and removed from, the anvil head, without removal of the rotary anvil from its supporting shaft; yet such a cover will remain in place against poorly set, overcutting, and tearing, rotary die knives.

The foregoing advantages and other recited objects are apparent from the following specification with the accompanying drawings.

DESCRIPTION OF PREFERRED EMBODIMENT

Figure 1:
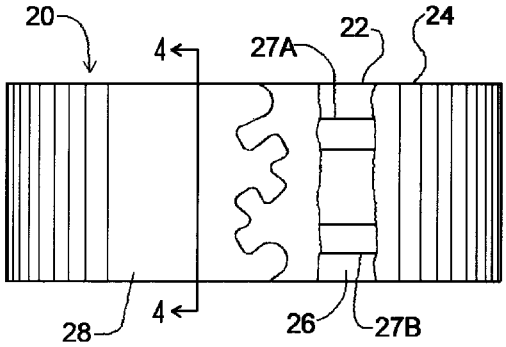
FIG. 1 is a side plan view of a rotary anvil including a unitary resilient cover, constructed in accord with the present invention, having a transverse portion, being broken away, for illustration of internal anvil detail.
Figure 2:
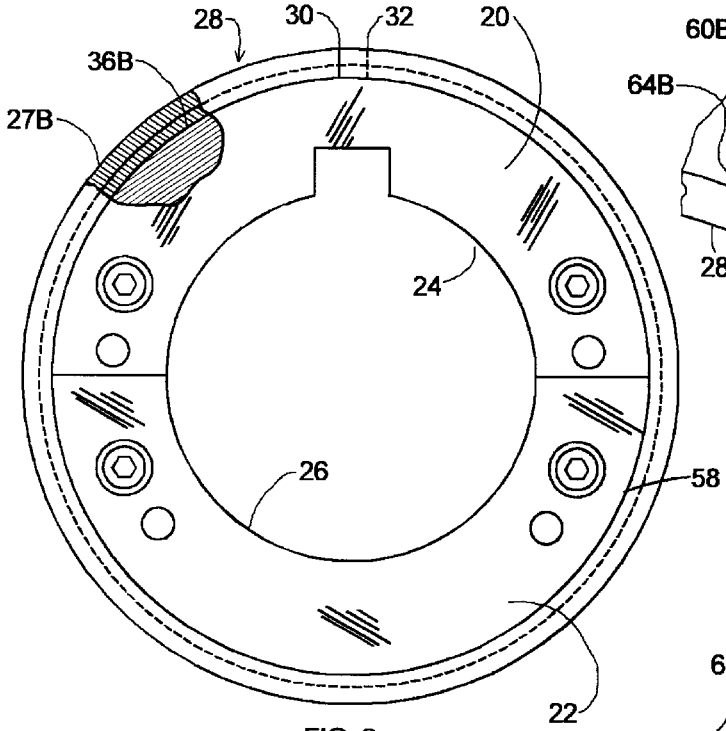
FIG. 2 is a top side downward view of the rotary anvil assembly of FIG. 1, also with a portion broken away for illustration of peripheral detail.

Referring now to the drawings, more particularly by reference numerals, there is illustrated a die cutting rotary anvil 20 including a circular anvil head 22 composed of two interlocked hemicircular sections 24, 26 (FIG. 2). Each anvil section has at least one annular slot 27A, having a rectilinear cross section, spaced apart, (note spaced-apart slot 27B in FIG. 1) with each such slot being offset from the cylinder-like peripheries of the anvil 20. Mounted on the anvil head is a resilient, collar-like member 28, serving as a cover, which cover includes longitudinal end, interlocked arcuate sections, 30 and 32 (FIG. 2), with these sections being of mateable end configurations. The displaceable cover 28 is conveniently of a resilient polyurethane polymer, like A-9 QM Pre-Polymer, available from Air Products, Inc., Allentown, Pa.; or it can be of another suitable thermosetting resin that can be molded into such shapes permanently after curing, but which will retain their surface resilience and flexibility.

The cover component 28 has at least one linear, protruding rail 34 (FIG. 7), or paired rails 36A, 36B (FIG. 3), all conveniently of a rectangular cross section, disposed on its inner surface which rail(s) complements the annular slots 27A, 27B, provided in the anvil outer surface (FIG. 1). A second slot member, 27B, is depicted in FIG. 1.

Figure 3:
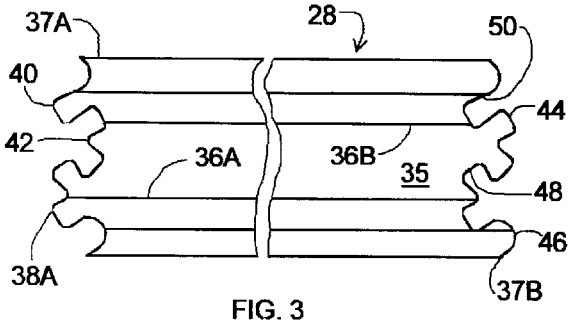
FIG. 3 is a view of the inner surface of the resilient cover of FIG. 1/2, but now stretched out flat, with a central portion cut away transversely for conservation of space, and for depiction of the mateable longitudinal ends.

In FIG. 3, looking at the cover inner surface 35 at one longitudinal end 37A of cover member 28, there are provided at least one forked tongue 38A, (and an offset single rounded tongue 40), along with an intermediate, like-configured, complemental end forked recess 42. At the other longitudinal end, 37B, of integral cover 28, there are provided at least one forked tongue protrusion 44, a lateral edge (rounded) single tongue 46, with an in-between complemental Vee-recess 48, and a marginal squared recess 50. Recesses 48 and 50 also serve as the lateral sidewalls of central forked tongue 44. This embodiment, also having the parallel, inner surface supporting rails 36A and 36B, are also seen in the perspective view of FIG. 3, with a central portion cut away for clarity. The parallel rails, 36A, 36B, themselves are necessarily sculpted (extruded) during cover fabrication to present the transverse configuration of the tongue and groove mating, to assure external surface stability, while they are interlocked.

Averting again to the top side, elevational view of anvil assembly FIG. 2, it will be seen how the arcuately flexed cover 28 surrounds the anvil 22 like a broad collar, and runs for a finite length along the elongate cylindrical surface 58 of the anvil 20, as needed. In the broken away portion of the periphery of assembly 20, the one cover rail 36B, as it seats in the complemental anvil slot 27B, is depicted.

It is now evident that upon effecting the unitary cover 28 encompassment of the rotary anvil 20, that the complemental tongue and groove sets on the opposing longitudinal ends will permit the annular cover rails 36A and 36B to nest snugly into the opposing anvil annular slots, 27A and 27B, while the cover is tightly mounted on the anvil itself. This will present a smooth arcuate outer surface for the assembly, which is required, while it is being utilized in the known cutting steps of converting planar corrugated paper stock to useful box board containers.

Figure 5:
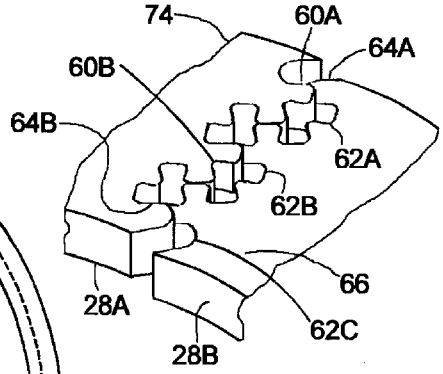
FIGS. 5 and 6 are fragmentary perspective views, illustrating the two steps which may be employed to manually mate and interlock the transverse ends of the one-piece cover of the embodiment of FIG. 9, into its functional position about an anvil.
Figure 6:
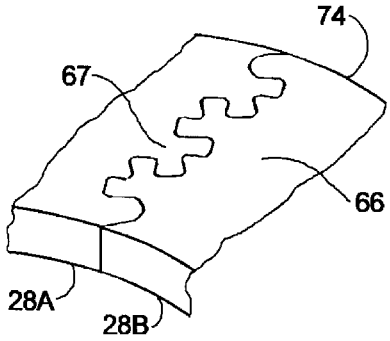

As will be apparent from the perspective view of FIG. 5, the depicted end array of dual forked tongues, 60A, 60B, and laterally-wide located, single tongue, 64B, all disposed on one longitudinal end 28A of cover 28, are aligned superimposed over the complemental opposing set of tongue and V-grooves, 62A/B, and of single tongue groove 62C, on opposing cover end 28B. Manual pressure will affect the engagement of the facing complemental arrays, yielding a smooth, continuous outer periphery 66 for the resulting ordered single seam 67 (FIG. 6) for the mounted anvil cover. In FIG. 6, the cover ends here are seen as smoothly interlocked, as when mounted on an anvil (see FIGS. 1–2). The mating surfaces interfit closely, so as to provide a substantially smooth cutting surface, upon which the knife edges of the roller (not seen) may bear repetitively.

Figure 4:
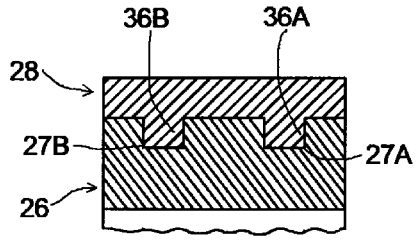
FIG. 4 is a transverse radial cross-sectional view, taken along substantially the line 4–4' of FIG. 1, depicting mounting of cover and anvil body.
Figure 7:
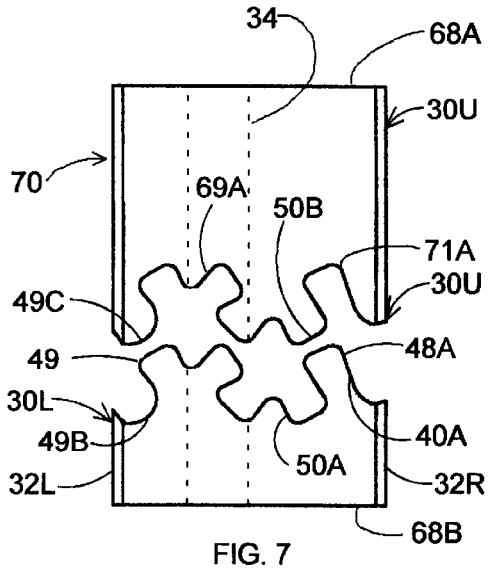
FIG. 7 is a top plan view, depicting the outer surface of a first embodiment of the resilient cover of the invention, with the single set (pair) of phantom lines depicting a protruding, single annular ridge integral on the reverse side, inner surface of the same cover embodiment with the mateable ends offset for clarity of view.

In the embodiment of FIG. 7, a somewhat narrower pair of mated end sections, 68A and 68B, of cover 70 are depicted. They do have a similar configuration to that of the end arrays of tongues and grooves, depicted in FIGS. 1 and 4, but this array set (40A, 50A) are of somewhat reduced overall dimensions, since the embodiment cover width itself is but 1.75". Also, only a single, linear rail 34 is depicted, as a cover of the indicated width can be sufficiently anchored on the anvil therewith.

According to the invention, in a first embodiment, there is provided a unitary cover for a rotary anvil, which anvil presents a cylindrical outer periphery having at least one circumferential slot therein, with the cover 70 being an elongate resilient component and having first and second longitudinal ends and two lateral edges, that are adapted to be flexed sufficiently to be mountable upon the anvil periphery for closure thereupon, during anvil usage, the cover 70 further comprising: (a) the cover having an inner surface (35 in FIG. 3) and outer (66 in FIG. 6) surface, both being arcuate while unflexed and having at least one longitudinally aligned, outwardly projecting, linear rail (34) integral within the one cover inner surface 35; the rail being sized and configured to engage upon mounting with the one annular, circumferential slot, like 27A provided in the anvil outer periphery; (b) the first (lower) longitudinal end 68B of the cover is provided with an interlockable, first array of protrusions further comprising: (i) a forked-tongue configuration, first protrusion 49A located proximal to one cover lateral edge 32L, and a single tongue configuration, second protrusion 48A, located proximal to the other lateral edge 32R of the cover, with both protrusions being spaced apart along the first longitudinal end 68B; (ii) a first arcuate-shaped recess 40A contiguous with the second protrusion 48A and overlapping the other lateral cover edge (32R) and a second arcuate recess 49B contiguous with the first protrusion and overlapping the other (32L) lateral cover edge; (iii) a third recess 50A in end 68B, having a reverse orientation of the forked configuration first protrusion, which is disposed in-between and contiguous with the first and second protrusions; and, (c) an opposing (upper) second longitudinal end (30U) of the cover being provided with an identical second array of protrusions, 49C and 50B, located transversely along the second longitudinal end (30U), first and second arcuate-shaped lateral edge recesses 69A and 71A, with the recesses being aligned conversely along such opposing longitudinal end, so as to permit complemental engagement with the first array disposed transversely along the first longitudinal end of the cover.

Figure 8:
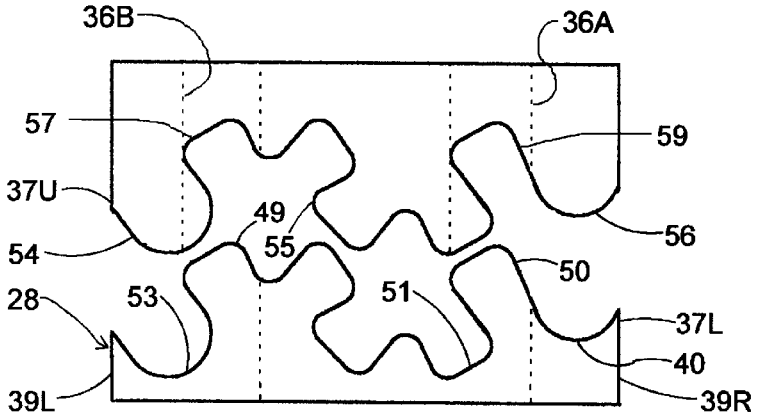
FIG. 8 is a top plan view, depicting the outer surface of a second (wider) embodiment of the resilient cover (converse surface seen in FIG. 3), with the two sets of paired phantom lines depicting a protruding pair of annular ridges on the reverse side, inner surface of this cover embodiment with the mateable ends offset for clarity of view.

As earlier noted, the plan view of FIG. 8 is of the dual rail, mixed configuration of the tongues embodiment of FIGS. 1 to 4. FIG. 8 shows an outside surface, plan view of the cross-section of the interlocked members of FIG. 4. Dimensions for this embodiment are a transverse width of 3.25", a longitudinal height from tongue outer edge to the bottom of the adjacent rounded recess of 0.845"; a single tongue maximum free end, width of 0.4142" and a base width of 0.3388"; the latter dimensions providing a tapering that aids pressure fitting of opposing tongue and grooves into one another. According to the invention, in a second embodiment, there is provided a unitary cover for a rotary anvil which underlying anvil presents a cylindrical outer periphery having two parallel annular slots therein (FIG. 1), with the cover comprising at least one elongate, resilient cover 28 having inner and outer surfaces, with the cover having first and second longitudinal ends (37U, 37L) and opposing lateral edges, adapted to be flexed sufficiently to be mountable upon the anvil periphery for closure thereupon, during anvil usage, the cover comprising: (a) a pair of circumferential linear rails, 36A, 36B, parallel and longitudinally aligned, both provided as being integral with the cover inner surface, and being sized and configured to engage themselves upon mounting with the opposing pair of annular, circumferential slots (27A, 27B) provided in the anvil 28 outer periphery, with each of such rails being offset from its proximal lateral cover edge, 39L and 39R, and with such pair of rails also essentially bracketing a phantom longitudinal center line of the inner surface of the unitary cover; (b) the first longitudinal (lower) end 37L of the unitary cover being provided with an interlockable first array of protrusions, further comprising: (i) a forked tongue configured, first protrusion (49) located proximal to one of the lateral edges 39L of the cover; (ii) a spaced apart, single tongue, second protrusion (50) located proximal to the other 39R lateral cover edge; (iii) a forked tongue-configured, first recess 51 disposed between the first and second (49, 50) protrusions; (iv) a single tongue-configured, second recess 53, disposed between the first protrusion (49) and the first (39L) lateral edge; (v) a single tongue-configured, third recess 40 disposed between the second protrusion 50 and the other lateral edge (39R) ; and, (d) the other longitudinal end (37U) of the cover being provided with a substantially identical, second array of first, second, and third protrusions (54, 55, and 56), first and second recesses (57 and 59), but with the second array being aligned conversely along the second longitudinal end so as to permit complemental engagement with the first array of protrusions and recesses disposed transversely along the first longitudinal end.

Figure 9:
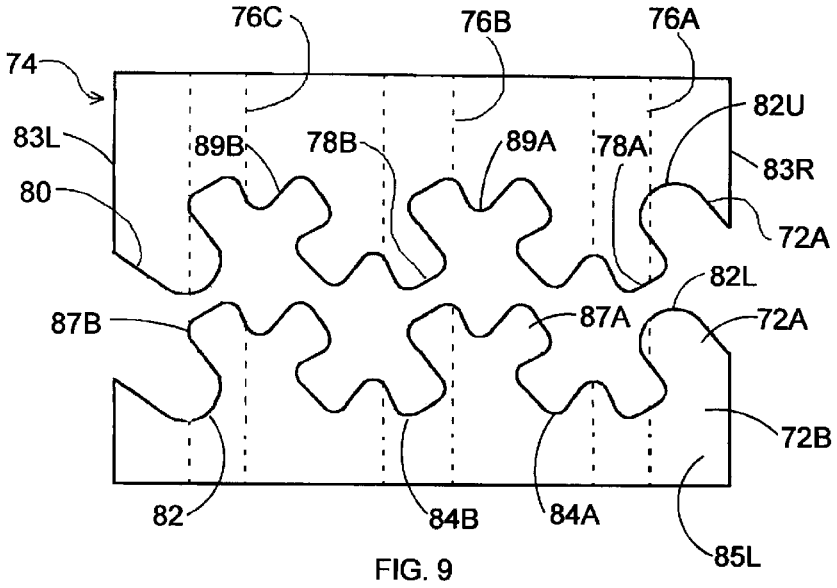
FIG. 9 is a top plan view, depicting the outer surface of an even larger (wider) embodiment of the resilient cover, with three sets of dual phantom lines depicting a protruding trio of annular ridges located on the reverse side, inner surface of this embodiment with the mateable ends offset for clarity of view.

The plan view of FIG. 9 is of the outer periphery of joinable, longitudinal ends, 72A and 72B, of cover 74, having a larger band width, for example, 5.25". This cover embodiment uses three integral rails, 76A, 76B, and 76C (shown in phantom), to engage the underlying anvil (not seen). Lower cover section 72B will be seen to have an identical, end array configuration to that of upper section 72A, when viewed head-on, while spaced apart. Theoretical 180° rotation of the one longitudinal end 72A superimposed over other end 72B will demonstrate the total coincidence of their precut transverse arrays. In the interlocking mode depicted, each cover end, like upper 72A, provides two, spaced-apart, forked tongues 78A and 78B, and one lateral concave (rounded) tongue 80 on lateral side 83L; and on the opposing cover section 72B, there is a complemental concave (rounded) groove 82, and two Vee-shaped grooves 84A, 84B. Two spaced apart forked tongues, 87A and 87B, are provided to engage forked recesses 89A and 89B.

According to the invention, in a third embodiment, there is provided a unitary cover for a rotary anvil component, which anvil component presents a cylindrical outer periphery having three parallel annular slots disposed therein, the cover comprising at least one elongate, resilient component having an inner and outer surface, with the cover having first and second longitudinal ends (72A, 72B) and two lateral edges 83L, 83R and adapted to be flexed sufficiently to be mountable upon the anvil component periphery for closure thereupon, during anvil usage, the cover further comprising: (a) a trio of first, second, and third linear rails (76A, 76B, 76C in phantom), parallel and longitudinally aligned, outwardly projecting and integral with the cover inner surface, being sized and configured to engage upon mounting within an opposing trio of first, second, and third annular slots, provided in the anvil outer periphery (not seen). Each of the outermost pair of rails 76A, 76C is offset from its proximal lateral cover edge, (e.g., rail 76A from lateral cover edge 83R), and with the outer pair of first and second rails (76A, 76C) with said rail pair also essentially bracketing a phantom longitudinal center line of the elongate cover; (b) the linear third rail (76B) is being disposed longitudinally between the first and second rails of the inner surface of the cover; (c) the first longitudinal end (72B) of the lower cover section being provided with an interlockable, first array of protrusions, further comprising: (i) a forked tongue-configured, first protrusion 87A located proximal to one of the lateral edges (83R) of the cover; (ii) a forked tongue-configured, second protrusion 87B located spaced apart from the first protrusion (87A) of the first longitudinal end of the cover; (iii) a spaced apart, single tongue-configured third protrusion 82L located proximal to the one lateral cover edge (83R); (iv) a forked tongue shaped, first recess 84A disposed between the first and third protrusions; (v) a forked tongue shaped, second recess 84B disposed between the second and first protrusions; (vi) a single tongue-shaped third recess 82 contiguous with the second protrusion and located proximal to the other lateral cover edge (83L); and, (d) the opposing (upper) longitudinal end 72A of the cover 74 being provided with a substantially identical, second array of first, second, and third protrusions (80, 78B, 78A), and first, second, and third recesses, 89A, 89B and 82U, but with the second array being aligned conversely along that other longitudinal end so as to permit complemental engagement with the first array of protrusions and recesses disposed transversely along the first longitudinal end.

It will be apparent with this embodiment, as with the other two depicted, that each cover has a similar configuration for the tongue and groove array at to as respective longitudinal ends, except that the array must be provided conversely, in the complemental mode, to achieve the smooth and reliable interlocking, as depicted in each embodiment of FIGS. 7, 8, and 9, throughout extended cycles of use.

It is to be understood that the foregoing description and the accompanying drawing have been given by way of illustration and example. It is also to be understood that changes in form of the elements, rearrangement of parts, and substitution of equivalent elements, which will be obvious to those skilled in the art, are contemplated as being within the scope of the present invention, which is limited only by the claims which follow.

What is claimed is:

1. A unitary cover for a rotary anvil, which anvil presents a cylindrical outer periphery having at least one circumferential slot therein, with the cover being an elongate resilient component and having first and second longitudinal ends and two lateral edges, being adapted to be flexed sufficiently to be mountable upon the anvil periphery for closure thereupon, during anvil usage, further comprising:

(a) the cover having an inner and outer surface, both being arcuate while unflexed and having at least one longitudinally aligned, outwardly projecting, linear rail integral within the cover inner surface, the rail being sized and configured to engage upon mounting with the one annular, circumferential slot provided in the anvil outer periphery;

(b) the first longitudinal end of the cover being provided with an interlockable, first array of protrusions further comprising:

(i) a forked-tongue configuration, first protrusion located proximal to one cover lateral edge, and a single tongue configuration, second protrusion located proximal to the other lateral edge of the cover with both being spaced apart along the first longitudinal end;

(ii) a first arcuate-shaped recess contiguous with the first protrusion and overlapping the one cover lateral edge and a second arcuate recess contiguous with the second protrusion and overlapping the other lateral cover edge;

(iii) a third recess having a reverse orientation of the forked configuration, first protrusion, which is disposed in-between and contiguous with the first and second protrusions; and, (c) the opposing second longitudinal end of the cover being provided with a complemental second array of protrusions located along the second longitudinal end comprising first and second protrusions, a first arcuate-shaped recess proximal to one lateral edge and an intermediately positioned, forked second recess, proximal the other lateral edge with the recesses being aligned conversely along the opposing second longitudinal end, so as to permit complemental engagement of the second array with the first array disposed transversely along the first longitudinal end of the cover.

2. The cover of claim 1 wherein two linear rails are provided in place of just one, both being parallel and longitudinally aligned, are provided integral with the cover inner surface, with each rail being offset from one proximal lateral edge of the cover, and with the rail pair essentially straddling a phantom longitudinal center line of the cover.

3. The cover of claim 1 wherein the single tongue configuration, second protrusion is angled inwardly from one lateral edge of the unitary cover.

4. A unitary cover for a rotary anvil component, which anvil component presents a cylindrical outer periphery having three parallel circumferential slots disposed therein, the cover comprising at least one elongate, resilient component having an inner and outer surface with the cover having first and second longitudinal ends and two lateral edges and adapted to be flexed sufficiently to be mountable upon the anvil component periphery for closure thereupon, during anvil component usage, the cover further comprising:

(a) a trio of first, second, and third linear rails, parallel and longitudinally aligned, outwardly projecting from and integral with the cover inner surface, being sized and configured to engage upon mounting within the three parallel circumferential slots provided in the anvil component outer periphery, with the first and second rails each being offset from and proximal to each lateral cover edge, and said first and second rails also essentially bracketing a phantom longitudinal center line of the elongate cover;

(b) the third linear rail being disposed longitudinally between the first and second rails of the inner surface of the cover;

(c) the first longitudinal end of the cover being provided with an interlockable, first array of protrusions, further comprising:

(i) a forked tongue-configured, first protrusion located proximal to one of the lateral edges of the cover;

(ii) a forked tongue-configured, second protrusion located spaced apart from the first protrusion of the first longitudinal end of the cover;

(iii) a spaced apart, single tongue-configured third protrusion located proximal to the other lateral cover edge;

(iv) a forked tongue shaped, first recess disposed between the first and second protrusions;

(v) a forked tongue shaped, second recess disposed between the second and third protrusions;

(vi) a single tongue-shaped third recess contiguous with the first protrusion and located proximal to the one lateral cover edge; and, (d) the opposing second longitudinal end of the cover being provided with a substantially identical, second array of first, second, and third protrusions, and first, second, and third recesses, but with the second array being aligned conversely along the second longitudinal end of the cover so as to permit complemental engagement with the first array of protrusions and recesses disposed transversely along the first longitudinal end of the cover.

5. The unitary cover of claim 4 wherein the single tongue-configured, third, protrusion located on each longitudinal end of the cover is angled inwardly from and proximal to the respective cover lateral edge.

6. The unitary cover of claim 4 wherein the single tongue, third recess located on each longitudinal end of the cover is angled inwardly from the respective other cover lateral edge.

7. The unitary cover of claim 4 wherein the third rail is located so as to substantially coincide with a longitudinal center line provided on the inner surface of the cover.

8. A unitary cover for a rotary anvil which anvil presents a cylindrical outer periphery having two parallel annular slots therein, the cover being an elongate, resilient component having inner and outer surfaces, with the resilient component having first and second longitudinal ends and opposing lateral edges, being adapted to be flexed sufficiently to be mountable upon the anvil periphery for closure thereupon, during anvil usage, the cover comprising:

(a) a pair of linear rails, parallel and longitudinally aligned, both provided as being integral with the cover inner surface, being sized and configured to engage themselves upon mounting with the opposing pair of annular slots provided in the anvil outer periphery, with each of the rails being offset from a respective proximal lateral cover edge, and with said pair of rails also essentially bracketing a phantom longitudinal center line of the inner surface of the unitary cover;

(b) the first longitudinal end of the unitary cover being provided with an interlockable first array of protrusions, further comprising:

(i) a forked tongue configured, first protrusion located proximal to one of the lateral edges of the cover;

(ii) a spaced apart, single tongue, second protrusion located proximal to the other lateral cover edge;

(iii) a forked tongue-configured, first recess disposed between the first and second protrusions;

(iv) a single tongue-configured, second recess disposed between the first protrusion and the one lateral edge of the cover;

(v) a single tongue-configured, third recess disposed between the second protrusion and the other lateral edge; and, (d) the other longitudinal end of the cover being provided with a, complemental second array of first and second protrusions, and first, and second recesses, but with the second array being aligned conversely along the second, longitudinal end so as to permit complemental engagement of the second array with the first array of protrusions and recesses disposed transversely along the first longitudinal end.

9. The cover of claim 8 wherein the single tongue second protrusion in each of the first and second arrays is angled inwardly from and adjacent to the respective lateral cover edge.

10. The cover of claim 8 wherein the resilient component is fabricated from a polyurethane polymeric material which is resilient when formed.

* * * * *